United States Patent [19]

Spradlin

[11] 4,103,170

[45] Jul. 25, 1978

[54] PORTABLE MEDICAL TABLE

[76] Inventor: Richard V. Spradlin, R.D. 1 Gurda La., Pine Island, N.Y. 10969

[21] Appl. No.: 835,822

[22] Filed: Sep. 22, 1977

[51] Int. Cl.[2] ..... A61G 1/00; A61G 13/00; G21K 5/08

[52] U.S. Cl. ..... 250/451; 5/82 R; 269/325

[58] Field of Search ..... 250/439, 444, 451, 456; 269/323, 324, 325; 128/376, 377; 5/82

[56] References Cited

U.S. PATENT DOCUMENTS

| | | | |
|---|---|---|---|
| 1,980,848 | 11/1934 | Cass | 250/451 |
| 2,869,614 | 1/1959 | Wamsley | 269/325 X |
| 3,200,416 | 8/1965 | Warrick | 269/325 X |
| 3,281,141 | 10/1966 | Smiley et al. | 269/325 |
| 3,411,766 | 11/1968 | Lanigan | 269/325 |
| 3,648,305 | 3/1972 | Ersek | 250/456 X |

*Primary Examiner*—Alfred E. Smith
*Assistant Examiner*—T. N. Grigsby
*Attorney, Agent, or Firm*—Oltman and Flynn

[57] ABSTRACT

Adjustable, hinged, table top sections above a rigid base respectively support the head, back, seat, upper and lower legs of the patient. Each top section has an open-ended horizontal slot for slidably receiving an X-ray plate, and vertical slots which are open at the top for slidably receiving X-ray plates on opposite sides of the patient on the table. Vertical slots in adjoining top sections register with each other for receiving together a single X-ray plate.

4 Claims, 5 Drawing Figures

PORTABLE MEDICAL TABLE

BACKGROUND OF THE INVENTION

Conventional techniques used in taking care of accident victims and other hospital patients often involve several transfers of the patient between various special purpose supports, such as stretchers, emergency room tables, and X-ray tables. Each time the patient is transferred, trained personnel should be in attendance to avoid possible injury to the patient and to minimize his discomfort. Moreover, even after the patient is on the X-ray table it may be necessary to prop an injured part of his body with towels or the like so as to position him for an X-ray picture that will effectively reveal the nature and extent of his injury.

SUMMARY OF THE INVENTION

The present invention is directed to a novel portable medical table that may be used to support an accident victim or other patient from the scene of the accident, or from the time of the patient's arrival at the hospital emergency room, throughout the examination and taking of X-rays.

A principal object of this invention is to provide a novel and improved portable medical table for use in hospitals and the like.

Another object of this invention is to provide such a table having slots positioned to receive X-ray plates in such a manner that informative X-ray pictures may be taken of virtually any part of the patient's body without disturbing his position on the table.

Further objects and advantages of this invention will be apparent from the following description of a presently-preferred embodiment, shown in the accompanying drawings in which.

Before explaining the present invention in detail, it is to be understood that the invention is not limited in its application to the arrangement illustrated in the accompanying drawings, since the invention is susceptible of other embodiments. Also, it is to be understood that the terminology used herein is for the purpose of description and not of limitation.

Figure 2:
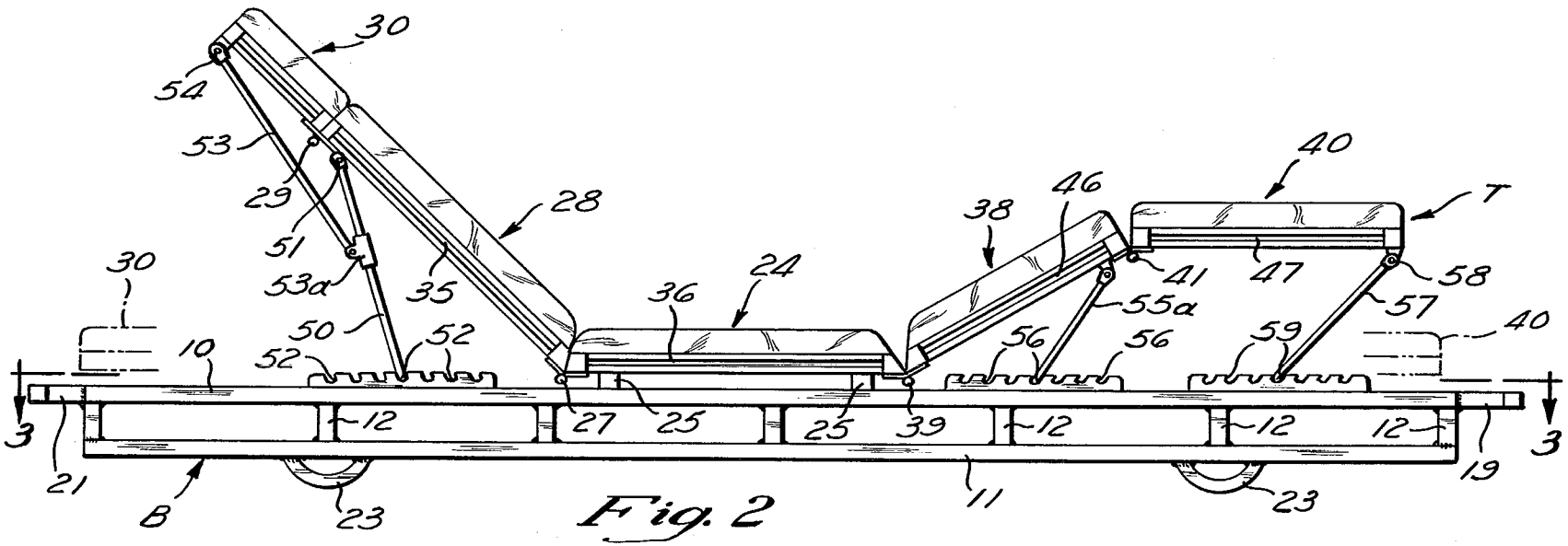
FIG. 2 is a side elevational view of this table with certain of the adjustable top sections adjusted angularly.

Referring first to FIG. 2, the present invention has a rigid base, indicated in its entirety by the reference letter B, and a hingedly adjustable, sectioned top, indicated in its entirety by the reference letter T.

Figure 3:
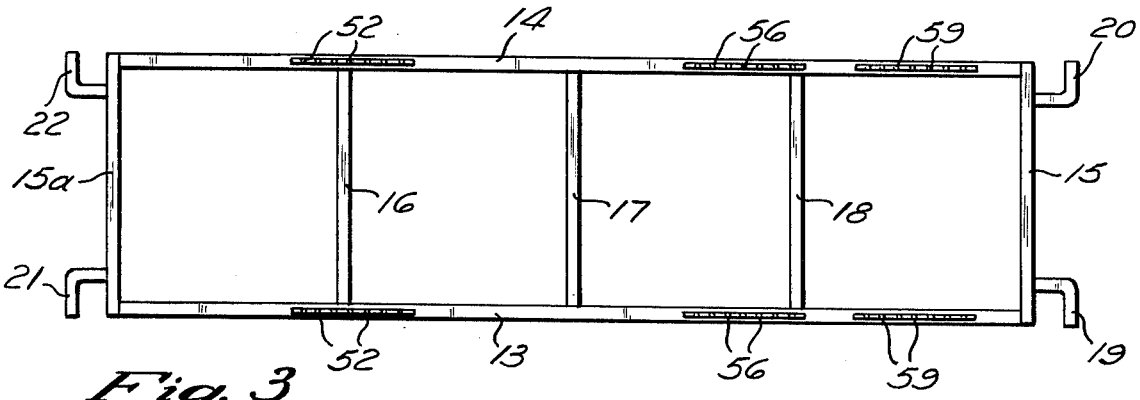
FIG. 3 is a top view of the base of this table, taking along the line 3—3 in FIG. 2.

As shown in FIG. 3, the base is rectangular in outline viewed from above. It has similar top and bottom members 10 and 11 (FIG. 2) spaced apart vertically by posts 12 (FIG. 2) which extend between them. As shown in FIG. 2, each post is welded at its lower end to the bottom member 10 and is welded at its upper end to the top member 11. However, if desired, the upper ends of these posts may be slidably received snugly in correspondingly positioned, downwardly-facing sockets in the top member 10 to permit the latter to be detached from the bottom member 11, when desired. In the latter case, suitable clamps (not shown) are provided for releasably locking the top member 10 to the bottom member 11 until it is time to separate them.

As shown in FIG. 3, the top member 10 has opposite longitudinal side rails 13 and 14, opposite end rails 15 and **15*a* extending from one side rail to the other, and cross rails 16, 17 and 18 extending between the side rails at appropriate intervals along their length to provide the desired structural rigidity. All of these rails are elongated horizontally. Handles 19, 20, 21 and 22** project beyond the respective end rails at each side.

The bottom member 11 of the base is essentially the same, except that it does not have the handles. The bottom member is provided with suitable downwardly projecting feet 23 on the bottom.

Preferably, both the top and bottom members 10 and 11 of the base are made of steel or aluminum tubing or bar stock.

The top of the table has a middle seat support section 24 which is rigidly attached to the top member 10 of the base by short vertical stubs 25 (FIG. 2) so that the seat support section 24 of the top extends substantially parallel to the base at all times. The seat support section 24 has a length and width enabling it to support the patient throughout the hip and the pelvic region. As best seen in FIG. 2, the seat support section has a generally semicircular opening 26 for toilet purposes. This opening may be covered by a removable cushioned insert when not in use.

One end of the seat support section 24 is connected by a hinge 27 (FIG. 2) at the bottom to the lower end of a back section 28. The opposite upper end of the back support section is connected by a bottom hinge 29 to the lower end of a head rest section 30. The back section 28 has a length and width sufficient to support the patient's back from about the hips up to the neck.

Figure 4:
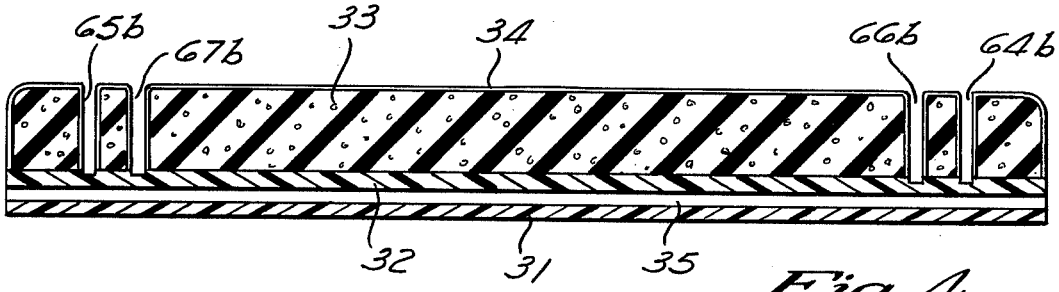
FIG. 4 is a cross-section taken through one of the sections of the table along the line 4—4 in FIG. 1.
Figure 5:
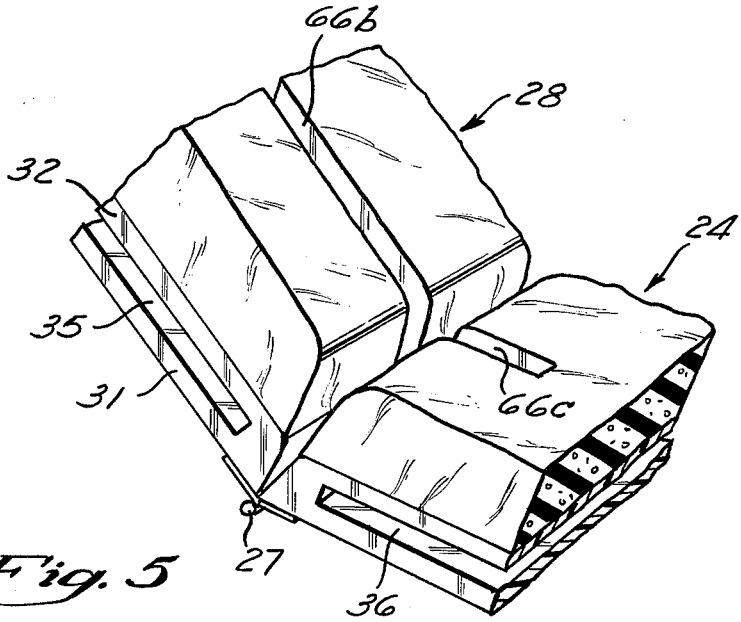
FIG. 5 is a fragmentary perspective view showing adjoining top sections of the table.

The cross-sectional construction of the back section 28 is shown in FIG. 4 as comprising a rigid, flat bottom plate 31, a rigid flat top plate 32 spaced above the bottom plate, and a top cushion 33 of foam rubber or other suitable cushioning material overlying the top plate 32 and provided with a suitable cover 34 of vinyl or the like. A normally horizontal slot 35 is provided between the bottom and top plates 31 and 32 for slidably receiving an X-ray film plate. This slot is open at one or both sides of the table, and preferably it extends throughout almost the complete length and width of the back section. The top plate 32 and the cushion 33, 34 are of suitable material that is substantially transparent to X-rays.

Both the seat support section 24 and the head rest section 30 are of the same construction as the back section. The seat support section has an open-ended normally horizontal slot 36 for receiving an X-ray plate, and the head rest section has an open-ended slot 37 for receiving an X-ray plate. Each of these slots has a length and width almost as great as those of the table top section in which it is formed, and each is open at one or both sides of the table so that an X-ray plate may be inserted and removed easily.

Figure 1:
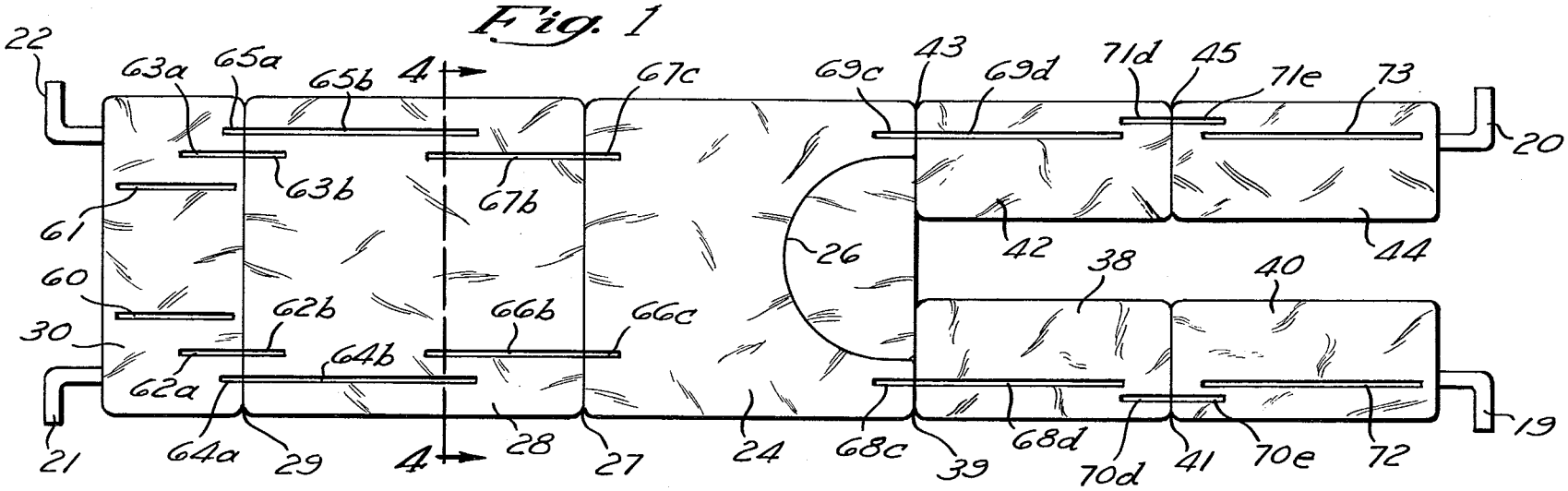
FIG. 1 is a top plan view of the present medical table with all of the adjustable top sections horizontal.

Referring to FIG. 1, the table top has an upper right leg support section 38 that is connected at one end to the adjacent end of the seat support section 24 at the right side by a bottom hinge 39 (FIG. 2). A lower right leg support section 40 is connected by a bottom hinge 41 to the opposite end of the upper right leg support section 38.

At the opposite (left) side the table top has an upper left leg support section 42 connected at one end by a bottom hinge 43 to the adjacent end of the seat support section 24, and a lower left leg support section 44 connected by a bottom hinge 45 to the opposite end of the upper left leg support section. The hinges 41 and 45 between the respective upper and lower leg support sections are located substantially at the position of the patient's knees.

Each upper leg support section and each lower leg support section has the same cross-section construction as the back support section 28, already described, and each provides a normally horizontal slot which is open at the adjacent side of the table. Only the slots 46 and 47 for the upper and lower right leg support sections 38 and 40, respectively, appear in FIG. 2. Each of these normally horizontal slots has a length and width almost as great as the overall length and width of the table top section in which it is located.

The back support section 28, head rest section 30, and the leg support sections 38, 40 and 42, 44 may all extend closely parallel to the top of the normally horizontal base B (as the seat support section 24 does at all times). When so positioned, the slots 36, 37, 46, 47 in these sections are substantially horizontal.

The back support and head rest sections 28, 30 are angularly adjustable as a unit to a raised position above the base. For this purpose a pair of rigid legs 50 at opposite sides of the table have their upper ends hingedly connected at 51 to the bottom of the back support section 28 close to the latter's hinged attachment at 29 to the head rest section 30. The free lower ends of these legs are received in upwardly-facing notches 52 which are closely spaced in succession along the length of the respective side rails 13 and 14 in the top member 10 of the base. By selecting the desired pair of notches, the angular position of the back support section 28 may be adjusted as desired.

The head rest section 30 is attached to the legs 50 by a pair of rigid braces 53 which have their upper ends pivotally connected at 54 to the bottom of the head rest section near the latter's outer end. The lower ends of these braces are connected to the legs 50 intermediate the latters' ends by respective slidable connectors 53*a*, so as to be adjustable along the legs 50 to permit angular adjustment of the head rest section 30 with respect to the back support section 28, when desired.

The angular position of the upper right leg support section 38 of the table top is determined by the position of a rigid leg 55 having its upper end pivotally connected at 55a to the bottom of section 38 near the hinge 41 which connects the upper right leg support section to the lower right leg support section 40. The lower free end of leg 55 is removably received in any of a series of upwardly facing notches 56, which are closely spaced in succession along the top of the side rail 13 on the top member of the base B.

A similar rigid leg 57 has its upper end hingedly connected at 58 to the bottom of the lower right leg support section 40 near the end of the latter remote from its hinged connection at 41 to the upper right leg support section 38. The leg 57 has a lower free end that is removably received in any of a series of upwardly facing notches 59, which are closely spaced in succession along the top of the side rail 13 on the top member of the base.

With this arrangement, the upper right leg support section 38 may be selectively adjusted angularly about the hinge 39 which connects it to the fixed seat support section 24, and the lower right leg support section 40 may be selectively adjusted angularly about the hinge 41 connecting it to the upper right leg support section 38, and the legs 55 and 57 support these right leg support sections of the table top in the position to which they have been adjusted.

An identical arrangement is provided for supporting the upper left leg support section 42 and the lower left leg support section 44 at any desired angular positions with respect to the base and with respect to each other.

In accordance with the present invention, the table top is formed with a plurality of normally vertical, downwardly extending, open-topped slots extending longitudinally of the table and shaped and dimensioned to snugly receive X-ray film plates, which are slidably inserted and removed from above. The downwardly facing slots are positioned in pairs, with the slots of each pair spaced apart laterally of the table to so as to be located on opposite sides of the corresponding part of the patient's body lying on the table top.

The head rest section 30 of the table top has a pair of laterally spaced, normally vertical, downwardly extending slots 60 and 61 which extend longitudinally of the table and are open at the top for slidably receiving respective X-ray film plates. These slots are spaced apart far enough to receive the patient's head between them and each of them is at least as long as the patient's skull.

The head rest section has similar downwardly extending slots 62*a* and 63*a*, which are located laterally outside the slots 60 and 61 and extend longitudinally from a position about midway along the slots 60 and 61 over to the edge of the head rest section where it is hinged to the upper end of the back rest section. The back support section has normally vertical, longitudinal slots 62*b* and 63*b* which are extensions of the head rest section slots 62*a* and 63*a* so that a single X-ray film plate may be inserted in the slots 62*a* and 63*a*, or a single X-ray film plate may be inserted in the slots 63*a* and 63*b*, for taking cervical X-rays from one side or the other.

The back support section 28 also has a pair of relatively long, normally vertical, downwardly extending slots 64*b* and 65*b* located laterally outward from the slots 62*b* and 63*b* and extending from its upper end (at hinge 29) for approximately three-quarters of its length. Adjacent the hinge 29 the head rest section has short normally vertical slots 64*a* and 65*a* which are extensions of the respective long slots 64*b* and 65*b* in the back support section. A single X-ray film plate may be inserted in the slots 64*a* and 65*b*, or a single X-ray film plate may be inserted in the slots 65*a* and 65*b*, for taking lumbar X-rays from one side or the other.

The back support section has another pair of normally vertical slots 66*b* and 67*b* located inboard of the slots 64*b* and 65*b*, respectively, and each extending from about midway along the back support section longitudinally to the lower end of the back support section (at hinge 27). The seat support section has normally vertical slots 66*c* and 67*c* which are short extensions of the slots 66*b* and 67*b*, respectively. For taking lumbar X-rays from one side or the other, a single X-ray film plate may be inserted in the slots 66*b* and 66*c*, or a single X-ray film plate may be inserted in the slots 67*b* and 67*c*.

The upper right leg support section 38 of the table top has a normally vertical slot 68*d* extending longitudinally from the end which is hingedly connected (at 39) to the seat support section almost to the opposite end. The seat support section 24 has a vertical slot 68*c* which is a short longitudinal extension of the slot 68*d*. A single X-ray film plate may be inserted in the slots 68*c* and 68*d* to take an X-ray of the upper right leg and femur.

The upper left leg support section 42 and the seat support section 24 have similar, registering, normally vertical slots 69*d* and 69*c* for receiving a single X-ray film plate to enable an X-ray to be taken of the upper left leg and femur.

On opposite sides of the hinge 41 between them, the upper right leg support section 38 and the lower right leg support section 40 of the table top have registering, normally vertical slots 70*d* and 70*e* in which a single X-ray film plate may be inserted for a right knee X-ray to be taken. These slots 70*d* and 70*e* are positioned outboard of the slot 68*d* in the upper right leg support section 38.

Similarly, the upper left leg support section 42 and the lower left leg support section 44 of the table top have registering, normally vertical slots 71*d* and 71*e* located on opposite sides of the hinge 45 for receiving a single X-ray film plate to enable a left knee X-ray to be taken.

The lower right leg support section 40 of the table top has a long, normally vertical slot 72 extending for most of its length at a location slightly inboard from the slot 70*e*. An X-ray film plate may be inserted in slot 72 to enable an X-ray to be taken of the right leg tibia and fibula, as well as the right foot.

The lower left leg support section 44 of the table top similarly has a long, normally vertical slot 73 extending for most of its length at a location slightly inboard from the slot 71*e*. An X-ray film plate may be inserted in slot 73 to enable an X-ray to be taken of the left leg tibia and fibula and the left foot.

This table may be used to support the patient continuously from either the scene of an accident or from the time of his entry into the hospital until after the necessary X-rays have been taken.

This table may be laid directly on top of a hospital bed without taking the patient off the table whenever this procedure may be advantageous or more convenient.

In using the table, the different top sections may be readily adjusted angularly for the maximum comfort and safety of the patient and the convenience of the medical personnel treating him. The normally horizontal slots in the top sections of the table for receiving X-ray film plates facilitate the taking of X-rays of any part of the patient's body from above. The normally vertical slots in the top sections of the table facilitate the taking of X-rays of any part of the patient's body from either side.

I claim:

1. In a portable medical table having a rigid base, and a plurality of top sections for supporting different parts of the body overlying the base and positioned in succession along the length of the base and individually adjustable to different positions with respect to each other, each of said support sections having downwardly extending slots which are open at the top for the slidable insertion and removal of X-ray plates, at least certain of said top sections each having a pair of said downwardly extending slots spaced apart laterally to be located on opposite sides of the part of the body supported by that top section, the improvement wherein successive top sections have downwardly extending, adjoining slots that register with and open toward each other for together receiving a single X-ray plate.

2. In a portable medical table having a rigid base, and a plurality of top sections for supporting different parts of the body overlying the base and positioned in succession along the length of the base and individually adjustable to different positions with respect to each other, each of said support sections having one or more slots for slidably receiving X-ray plates including normally horizontal slots which are open at a side of the table for the slidable insertion and removal of X-ray plates and downwardly extending slots which are open at the top of the respective top sections for the slidable insertion and removal of X-ray plates, at least certain of said top sections each having a pair of said downwardly extending slots spaced apart laterally to be located on opposite sides of the part of the body on that top section, the improvement wherein successive top sections have downwardly extending, adjoining slots that register with and open toward each other for together receiving a single X-ray plate.

3. In a portable medical table having a rigid base, and a plurality of top sections for supporting different parts of the body overlying the base and positioned in succession along the length of the base and individually adjustable to different positions with respect to each other, said top sections being pivotally interconnected to each other at horizontal pivots extending in a side-to-side direction on the table, said top sections comprising a back support section, a seat support section hingedly connected at one end to the lower end of the back support section, an upper left leg support section hingedly connected at one end to the opposite end of the seat support section at the left side of the table, a lower left leg support section hingedly connected to the opposite end of the upper left leg support section from the seat support section, an upper right leg support section hingedly connected at one end to said opposite end of the seat support section at the right side of the table, and a lower right leg support section hingedly connected to the opposite end of the upper right leg support section from the seat support section, at least certain of said top sections each having a pair of downwardly extending slots which are open at the top of the respective top section for slidably receiving X-ray plates and spaced apart laterally to be positioned on opposite sides of the part of the body on that top section, the improvement wherein successive top sections have downwardly extending, adjoining slots that register with and open toward each other for together receiving a single X-ray plate.

4. In a portable medical table having a rigid base, and a plurality of top sections for supporting different parts of the body overlying the base and positioned in succession along the length of the base and individually adjustable to different positions with respect to each other, said top sections being pivotally interconnected to each other at horizontal pivots extending in a side-to-side direction on the table, said top sections comprising a back support section, a seat support section hingedly connected at one end to the lower end of the back support section, an upper left leg support section hingedly connected at one end to the opposite end of the seat support section at the left side of the table, a lower left leg support section hingedly connected to the opposite end of the upper left leg support section from the seat support section, an upper right leg support section hingedly connected at one end to said opposite end of the seat support section at the right side of the table, and a lower right leg support section hingedly connected to the opposite end of the upper right leg support section from the seat support section, each of said top sections having a normally horizontal slot which is open at a side of the table for slidably receiving an X-ray plate, and at least certain of said top sections each having two downwardly extending slots which are open at the top of the respective top section for slidably receiving X-ray plates and are spaced apart laterally to be positioned on opposite sides of the part of the body on that top section, the improvement wherein adjoining top sections have downwardly extending, neighboring slots that register with and open toward each other for together receiving a single X-ray plate.

* * * * *